US009634394B2

(12) United States Patent
Vale

(10) Patent No.: US 9,634,394 B2
(45) Date of Patent: Apr. 25, 2017

(54) ANTENNA ARRANGEMENT

(71) Applicant: Alaris Antennas (Pty) Limited, Centurion (ZA)

(72) Inventor: Christopher Alfred Wolfgang Vale, Johannesburg (ZA)

(73) Assignee: ALARIS ANTENNAS (PTY) LIMITED, Centurion (ZA)

( * ) Notice: Subject to any disclaimer, the term of this patent is extended or adjusted under 35 U.S.C. 154(b) by 101 days.

(21) Appl. No.: 14/353,382

(22) PCT Filed: Oct. 23, 2012

(86) PCT No.: PCT/IB2012/055827

§ 371 (c)(1),
(2) Date: Apr. 22, 2014

(87) PCT Pub. No.: WO2013/061249

PCT Pub. Date: May 2, 2013

(65) Prior Publication Data

US 2014/0266940 A1 Sep. 18, 2014

(30) Foreign Application Priority Data

Oct. 24, 2011 (ZA) ..... 2011/07758

(51) Int. Cl.
*H01Q 9/16* (2006.01)
*H01Q 1/08* (2006.01)
(Continued)

(52) U.S. Cl.
CPC ..... *H01Q 9/16* (2013.01); *H01Q 1/084* (2013.01); *H01Q 7/02* (2013.01); *H01Q 9/12* (2013.01);
(Continued)

(58) Field of Classification Search
CPC ..... H01Q 9/16; H01Q 1/084; H01Q 21/00; H01Q 9/12; H01Q 21/062; H01Q 7/02; H01Q 9/18; H01Q 21/14
See application file for complete search history.

(56) References Cited

U.S. PATENT DOCUMENTS 4,205,317 A * 5/1980 Young ..... H01Q 9/065 343/720
5,068,672 A * 11/1991 Onnigian ..... H01P 5/10 343/821

(Continued)

FOREIGN PATENT DOCUMENTS

FR 890 195 1/1944
JP 56-027508 3/1981

OTHER PUBLICATIONS

International Search Report mailed Feb. 11, 2013 in Application No. PCT/IB2012/055827.

*Primary Examiner* — Graham Smith
*Assistant Examiner* — Noel Maldonado
(74) *Attorney, Agent, or Firm* — Knobbe, Martens, Olson & Bear LLP

(57) ABSTRACT

An antenna arrangement 10 comprises a first elongate limb 12 and a second elongate limb 14. The first and second elongate limbs converge towards one another at a first electrical connection point 16 and a spaced anti-phase electrical connection point 18. The first and second limbs collectively forming a closed figure with a first appendage 22, a second appendage 24, a third appendage 26 and a fourth appendage 28 to the closed figure.

13 Claims, 11 Drawing Sheets

(51) Int. Cl.

| | |
|---|---|
| ***H01Q 7/02*** | (2006.01) |
| ***H01Q 9/12*** | (2006.01) |
| ***H01Q 9/18*** | (2006.01) |
| ***H01Q 21/06*** | (2006.01) |
| ***H01Q 21/14*** | (2006.01) |
| ***H01Q 21/00*** | (2006.01) |

(52) U.S. Cl.
CPC ..... *H01Q 9/18* (2013.01); *H01Q 21/00* (2013.01); *H01Q 21/062* (2013.01); *H01Q 21/14* (2013.01)

(56) References Cited

U.S. PATENT DOCUMENTS

| | | | | |
|---|---|---|---|---|
| 2004/0070548 | A1 | 4/2004 | Cake | |
| 2013/0169505 | A1* | 7/2013 | Shmuel ..... | H01Q 1/088 343/848 |

* cited by examiner

ANTENNA ARRANGEMENT

REFERENCE TO RELATED APPLICATIONS

This application is the U.S. National Phase of International Application PCT/IB2012/055827, filed Oct. 23, 2012, and claims priority to ZA Application No 2011/07758, filed Oct. 24, 2011. Each of the priority applications is hereby incorporated by reference in its entirety.

INTRODUCTION AND BACKGROUND

This invention relates to an antenna arrangement and to an antenna array comprising the arrangement, including a collapsible arrangement and array.

In radio direction finding applications, it is known to use loop-based Watson-Watt arrays or Adcock arrays. Loop-based Watson-Watt arrays are generally perceived to be inferior to Adcock arrays, mainly due to the inherent sensitivity of loop-based radiators to horizontal polarization (HP), which causes unavoidable estimation errors when the incoming wave is not purely vertically polarized (VP), and secondly, due to inaccuracy when waves are incident from high angles of elevation. These problems often come to the fore at low frequencies (in the HF band) with sky wave propagation, but not ground wave propagation. At higher frequencies, however, ground waves support appreciable HP and loops then suffer accuracy degradation due to cross-polarization making them unpopular for use in the upper HF and VHF regions and above. Adcock arrays suffer a disadvantage over loop elements from a sensitivity point of view when the arrays are small in size, which makes Adcock arrays less desirable for use in small tactical systems that are expected to work below 100 MHz.

OBJECT OF THE INVENTION

Accordingly it is an object of the present invention to provide an alternative antenna arrangement and array with which the applicant believes the aforementioned disadvantages may at least be alleviated or which may provide a useful alternative for the known arrangements and arrays.

SUMMARY OF THE INVENTION

According to the invention there is provided an antenna arrangement comprising:

- a first elongate limb and a second elongate limb;
- the first and second elongate limbs converging towards one another at a first electrical connection point and a spaced second anti-phase electrical connection point; and
- the first and second limbs collectively forming a closed figure with first, second, third and fourth appendages to the closed figure.

In use, the first and second antenna arrangement connection points may be connected to first and second ports of electronic circuitry which are 180 degrees out of phase. The circuitry may comprise transmitter circuitry, so that the arrangement may act as a transmitting antenna arrangement. Alternatively, the circuitry may comprise receiver or detector circuitry, so that the arrangement may act as a receiving antenna arrangement.

Further alternatively, the circuitry may comprise both transmitter and receiver circuitry, so that the arrangement may act as a transceiving arrangement.

In one embodiment of the invention the closed figure and appendages are of an electrically conductive material and each of the appendages extends in spaced juxtaposition along a region of the closed figure adjacent thereto.

The closed figure may have any suitable shape, including but not limited to rectangular, square and rounded, such as elliptical or circular.

In another embodiment the first and second appendages form a first dipole and the third and second appendages form a second dipole.

In one form of this embodiment, the closed figure may be made of an electrically insulating material, so that the first dipole and the second dipole are spaced from one another adjacent opposite regions of the insulating closed figure.

In another form, the closed figure, the first appendage, second appendage, third appendage and fourth appendage are made of an electrically conductive material, so that there is provided a hybrid loop antenna comprising the closed figure forming a loop antenna and the first and second dipoles adjacent opposite regions of the loop antenna.

The antenna arrangement may comprise a first hinge and a second hinge connecting the first and second limbs to one another with the first hinge between the first and second appendages and the second hinge between the third and fourth appendages. A third hinge may be provided on the first limb between first and second hinges and a fourth hinge may be provided on the second limb between the first and second hinges, so that the arrangement is manipulatable between a first or deployed configuration and a second collapsed configuration wherein the first and second hinges are closer to one another than in the deployed configuration.

The closed figure may have any suitable shape such as rectangular, square, rounded, such as elliptical or circular or even a non-canonical shape. Similarly the appendages may also have any suitable shape such as rectangular, square, triangular, rounded, such as elliptical or circular or even a non-canonical shape.

The invention also includes within its scope an antenna array comprising a first arrangement as as herein defined and/or described and a second similar arrangement in mutually orthogonal relationship relative to one another and with each arrangement connectable to its respective electronic circuitry.

BRIEF DESCRIPTION OF THE ACCOMPANYING DIAGRAMS

The invention will now further be described, by way of example only, with reference to the accompanying diagrams wherein.

DESCRIPTION OF A PREFERRED EMBODIMENT OF THE INVENTION

Figure 1:
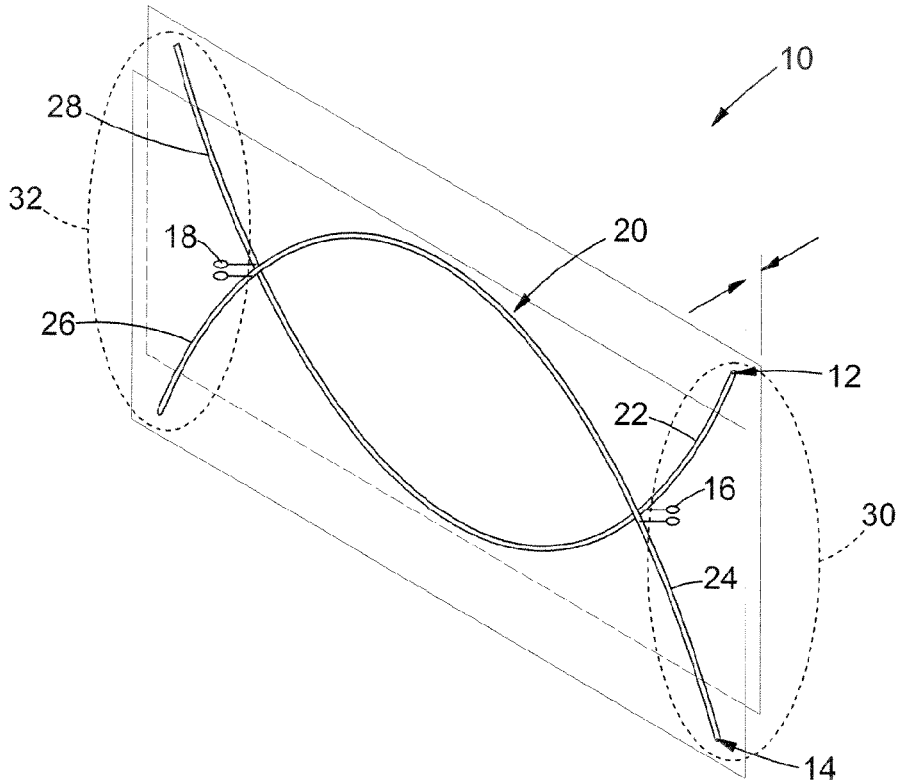
FIG. 1 is a basic and diagrammatic representation of an antenna arrangement.

In the diagrammatic representation in FIG. 1, an antenna arrangement which may form part of an antenna array, is generally designated by the reference numeral 10. An example embodiment of the array is generally designated 100 in FIGS. 11 and 12.

Referring to FIG. 1, the arrangement 10 comprises a first elongate limb 12 and a second elongate limb 14. The first and second elongate limbs converge towards one another at spaced first and second anti-phase antenna arrangement connection points 16, 18, so that the first and second limbs collectively form a closed figure with a first appendage 22, a second appendage 24, a third appendage 26 and a fourth appendage 28 to the closed figure.

Figure 2:
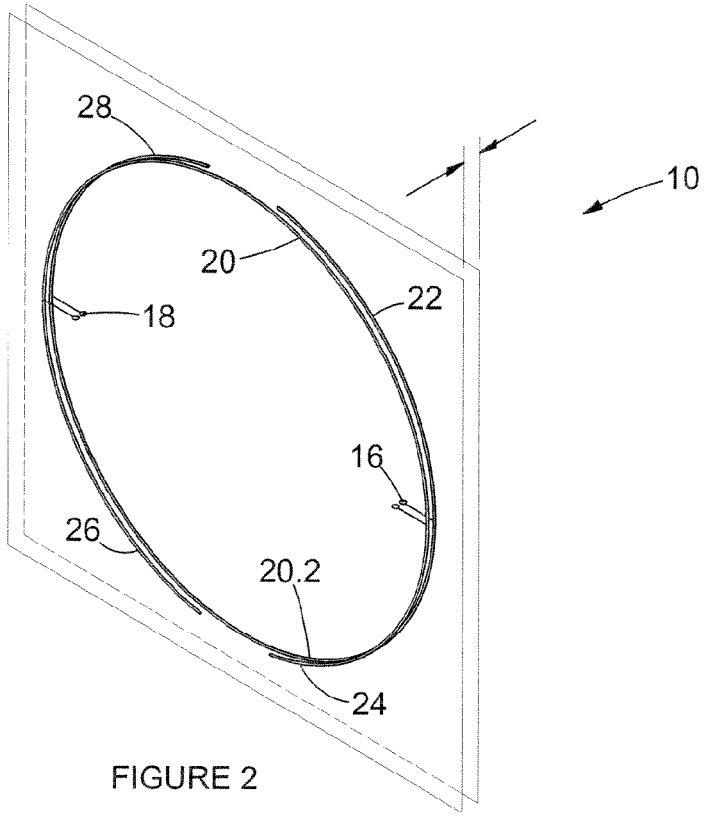
FIG. 2 is a similar representation of a first form of the antenna arrangement in FIG. 1.

In FIG. 2, one form of the antenna arrangement 10 is shown wherein the arrangement forms an alternative loop antenna. The closed figure and appendages 22, 24, 26 and 28 are made of an electrically conductive material and each of the appendages extend in spaced juxtaposition along a region of the closed figure adjacent thereto. For example, appendage 24 extends away from the connection point 16 in spaced juxtaposition relative to the adjacent region of the close figure towards point 16. More particularly, the closed figure or loop 20 is circular and the appendage 24 is in the shape of a circle segment extending in spaced juxtaposition relative to adjacent circle segment region 20.1 of the loop 20. The appendages may come close to each other at their free ends, but do not meet at their free ends. In this topology, the appendages 22, 24, 26 and 28 interact electromagnetically as parasitic elements with the conductor of the close figure.

It has been found that the embodiment is resistant to cross polarization, and the folding back of the appendages towards the closed figure makes it feasible to make a practical implementation of the antenna arrangement.

Figure 3:
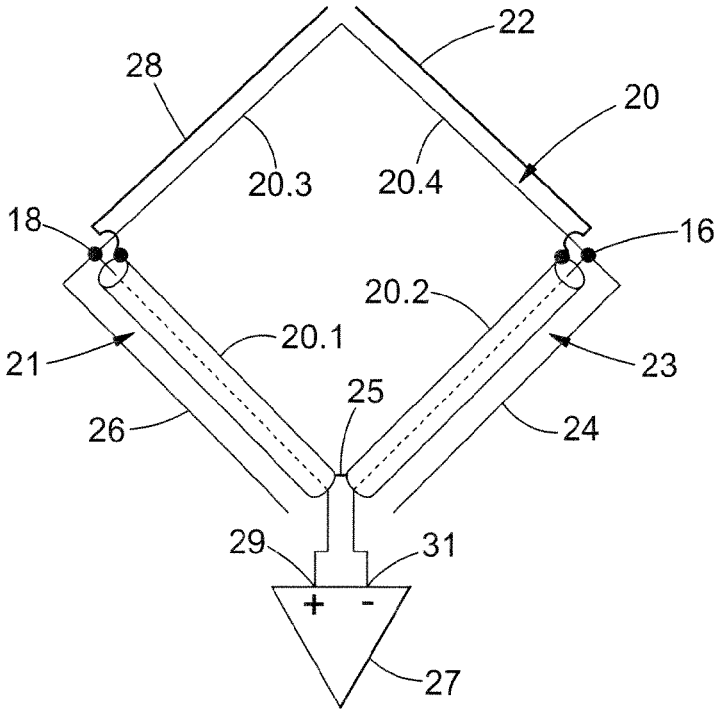
FIG. 3 is a more detailed representation of the antenna arrangement in FIG. 2.

In FIG. 3, there is shown a more detailed implementation of the antenna arrangement of FIG. 2. In this case, the closed figure or loop is square and the appendages 22, 24, 26 and 28 extend parallel to the respective adjacent sides of the loop. First and second sides 20.1 and 20.2 of the loop are formed by outer conductors of first and second coaxial cables 21 and 23 respectively, which are bridged at adjacent ends 25. The centre conductors are connected at one ends thereof to electronic circuitry 27 (which in this example embodiment is receiver or detector circuitry, but it may also be transmitter circuitry or transceiver circuitry) having a first port 29 and a second port 31 which are 180 degrees out of phase. At their other ends, the centre conductors are connected to the anti-phase connection points 16 and 18 respectively. The third and fourth sides 10.3 and 20.4 of the loop are connected to the aforementioned centre conductors at connection points 16 and 18, to form the loop. The first appendage 22 is connected to the outer conductor of the second coaxial cable 23 and the second appendage 24 is connected to the centre conductor of the second coaxial cable. The third appendage 26 is connected to the centre conductor of the first coaxial cable 21 and the fourth appendage 28 is connected to the outer conductor of the first coaxial cable 21. Although shown on the outside of the loop 20, the appendages may alternatively extend in spaced parallel relationship with the sides of the loop, on the inside of the loop.

Figure 4:
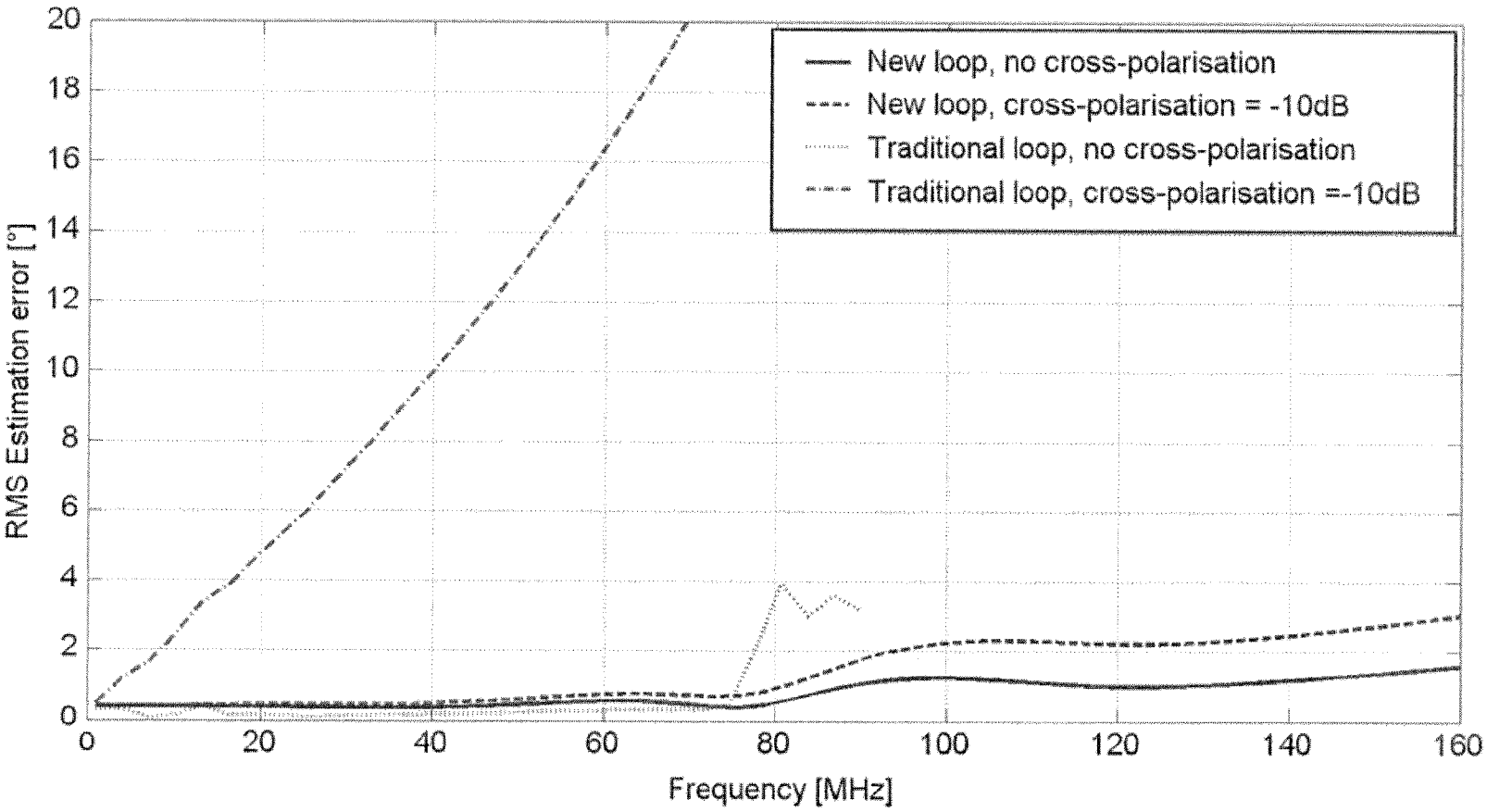
FIG. 4 show comparative graphs of RMS estimation error against frequency for a conventional loop antenna and the antenna of FIG. 3.
Figure 5:
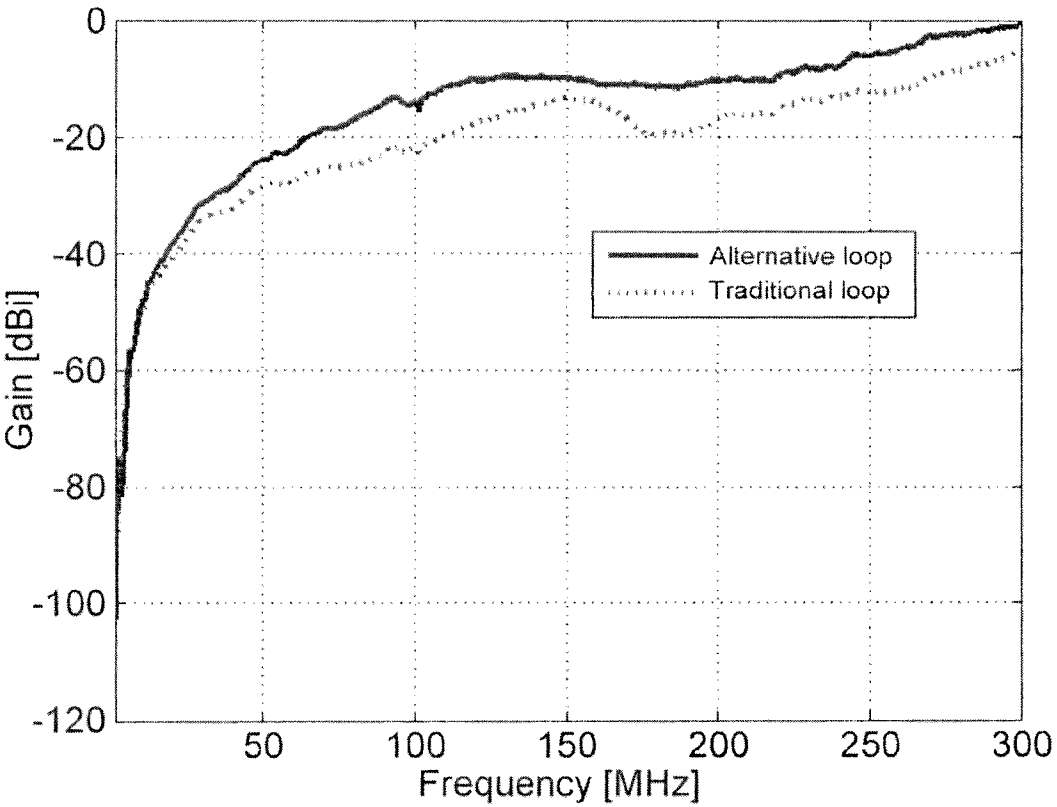
FIG. 5 show comparative graphs of peak gain against frequency for a conventional loop antenna and the antenna of FIG. 3.

When the connection points 16 and 18 are fed in anti-phase and the antenna is transmitting, or when the antenna is receiving signals and the received signals at the connection points 16 and 18 are subtracted from each other, the antenna behaves as a stable loop antenna over a wide range of frequencies providing the following performance advantages: a) improved cross polarization discrimination over a wider band than a normal loop antenna as shown in FIG. 4; b) resistance to practical manufacturing tolerances compared to current state of the art topologies; and c) improved gain performance over a conventional loop antenna of the same size, as shown in FIG. 5.

Figure 6:
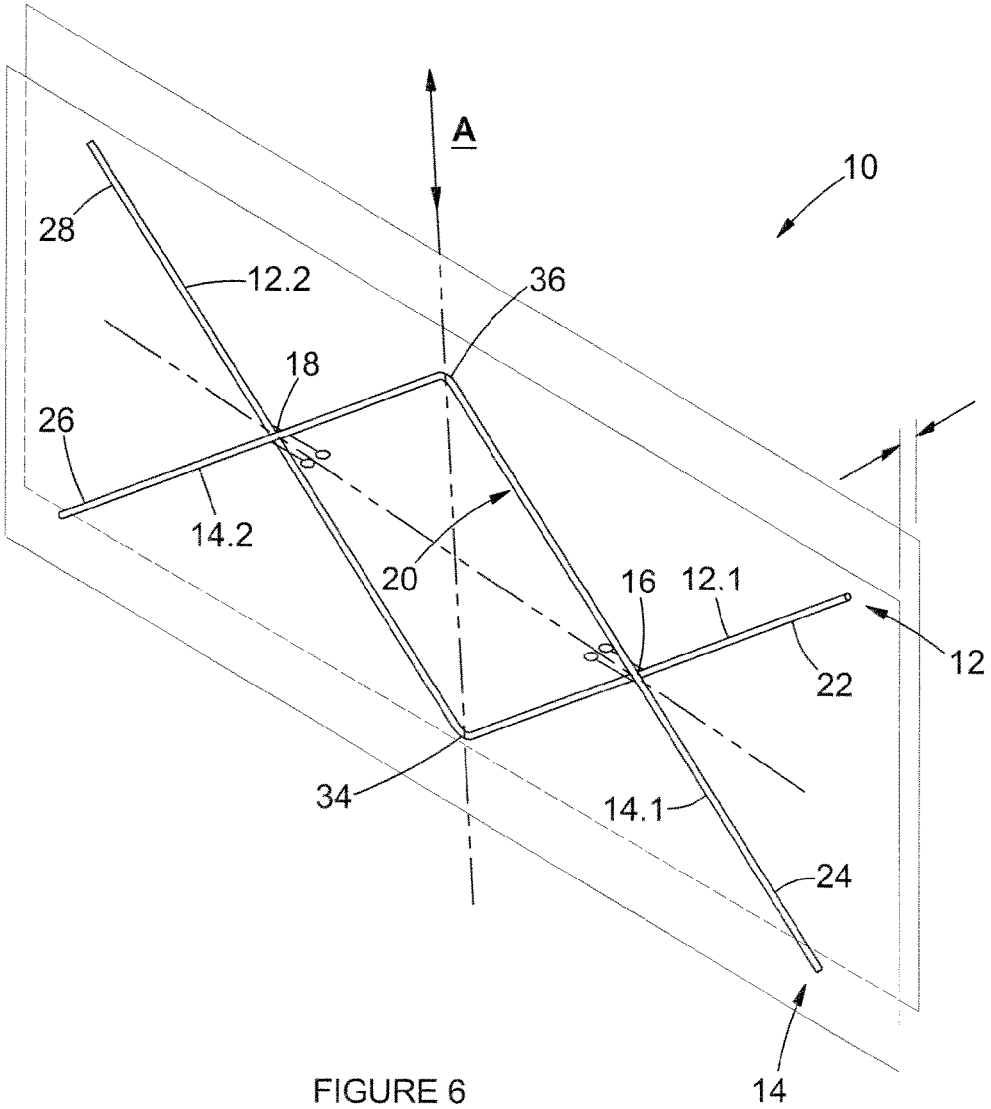
FIG. 6 is a more detailed representation of a second form of the antenna arrangement of FIG. 1.

In FIG. 6 there is shown a more detailed presentation of another form of the antenna arrangement 10 in FIG. 1. The first elongate limb 12 comprises a first linear and rigid part 12.1 and a second linear and rigid part 12.2. The second elongate limb comprises a first linear and rigid part 14.1 and a second linear and rigid part 14.2. The first antenna arrangement connection point 16 is at a first hinge where the first part 12.1 of limb 12 and the first part 14.1 of second limb 14 are hingedly connected to one another. The second antenna arrangement connection point 18 is at a second hinge where the second part 12.2 of limb 12 and the second part 14.2 of second limb 14 are hingedly connected to one another. The first and second parts of the first limb 12 are hinged together at third hinge 34 and the first and second parts of limb 14 are hinged together at fourth hinge 36.

The arrangement is manually or automatically manipulatable between a first or deployed configuration and a second or collapsed configuration by manually manipulating the hinges 34 and 36 as shown at A between a first position wherein the connection points 16 and 18 are spaced form one another and a second position wherein the connection points are closer to one another than in the deployed configuration. It has been found that in at least some embodiments, the array functions as an antenna array throughout a substantial part of the continuously variable range of movement that the hinges and geometry allow between the collapsed and deployed configurations. However, it is expected that performance may degrade closer to the collapsed configuration.

Figure 7:
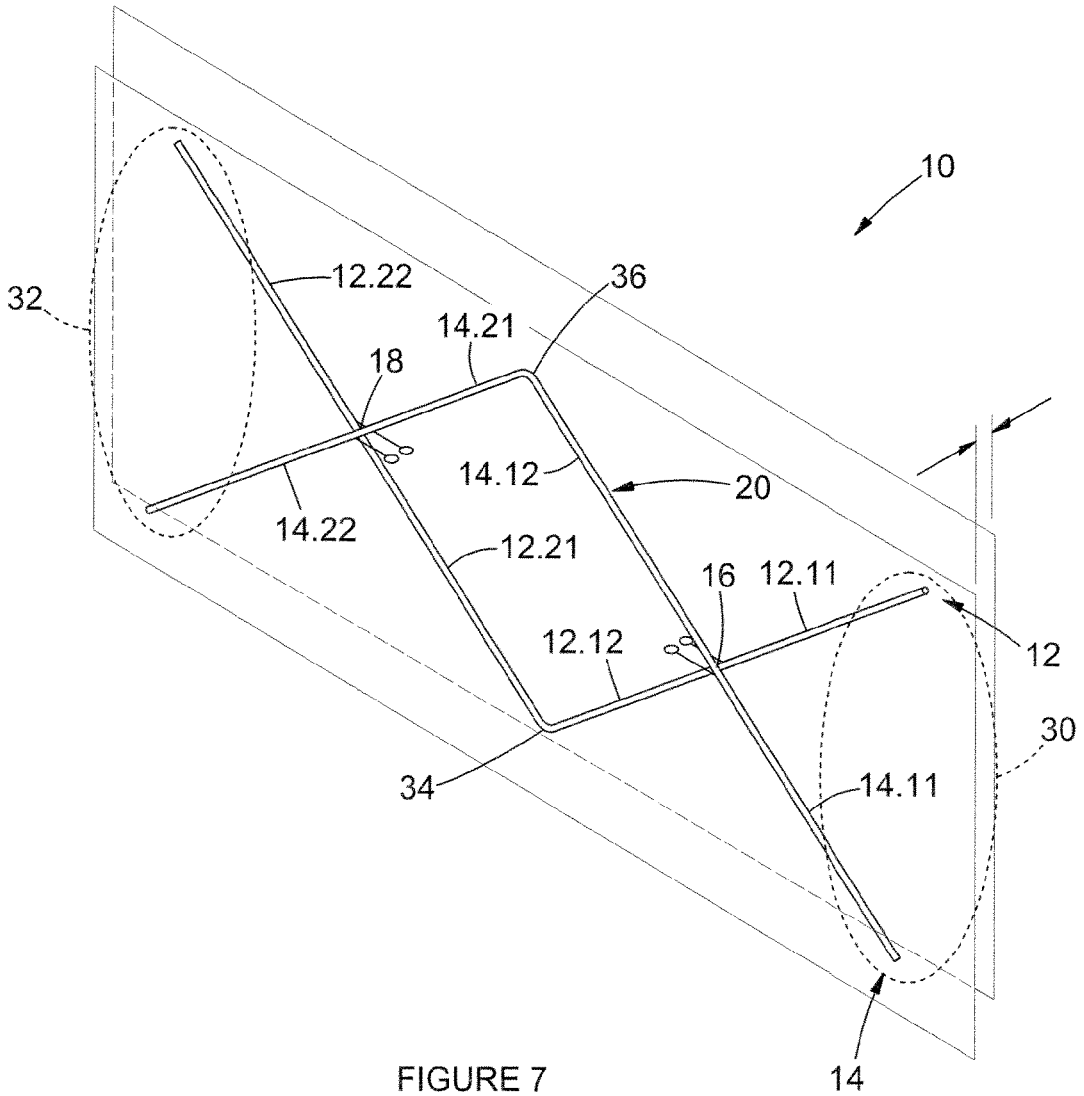
FIG. 7 is a similar representation of one embodiment of the antenna arrangement of FIG. 6.

Referring to FIG. 7, in some embodiments, the parts of limbs 12 and 14 collectively form the closed figure, namely parts 12.12, 14.12, 14.21 and 12.21 are made of an electrically insulating material whereas the parts 12.11, 14.11, 14.22 and 12.22 forming the appendages 22, 24, 26 and 28 are made of an electrically conductive material. In such embodiments, the arrangement 10 comprises two spaced dipole antennas 30 and 32 adjacent opposite regions of the closed figure.

In other embodiments, all of the parts of the limbs 12 and 14 are made of an electrically conductive material, so that the arrangement is a hybrid comprising a loop antenna 20 with the two spaced dipole antennas 30 and 32 adjacent opposite regions of the loop.

Figure 8:
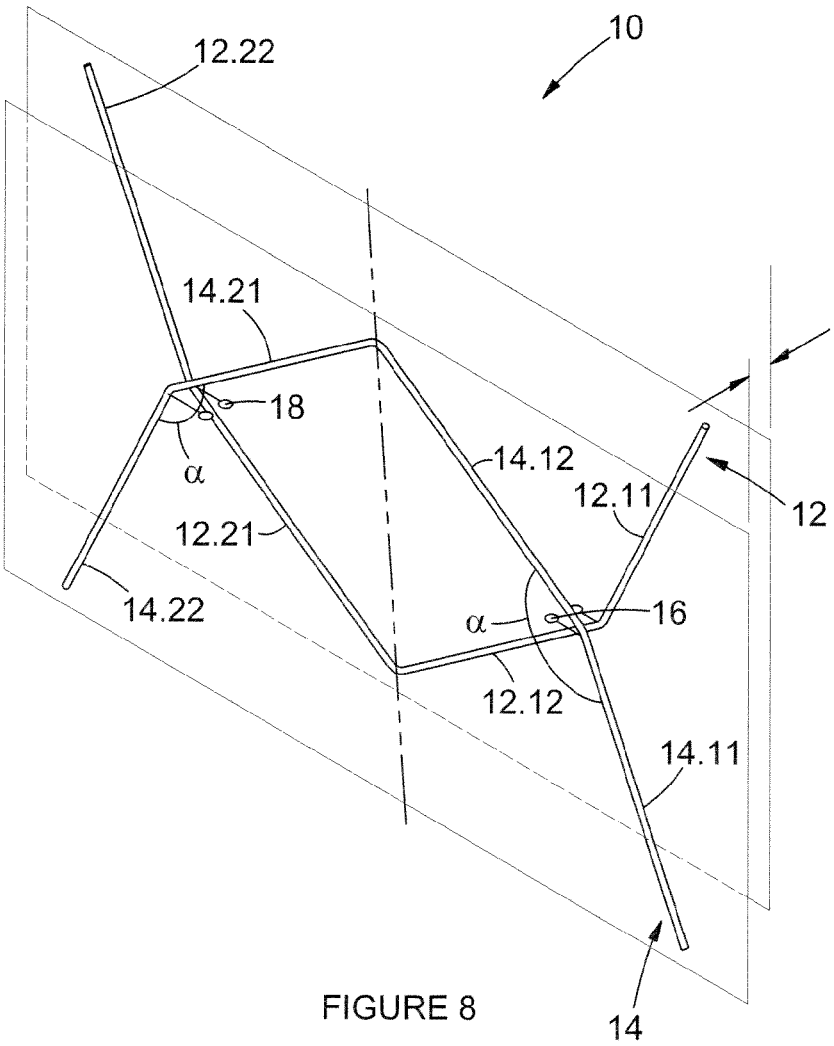
FIG. 8 is a similar representation of another embodiment of the antenna arrangement of the antenna arrangement of FIG. 6.

Referring to FIG. 8, in this embodiment there is provided an angle α of about 153° between the first and second parts of each of the first and second parts 12.1 and 12.2 of the elongate limb 12. Similarly, the angle α is also provided between the first and second parts of each of the first and second parts 14.1 and 14.2 of the elongate limb 14.

In one form of the embodiment of FIG. 8, the parts 12.12, 12.21, 14.21 and 14.12 are about 145 mm in length. The appendages 12.11, 14.11, 14.22 and 12.22 are about 180 mm in length. When collapsed, the appendages 12.11, 14.11, 14.22 and 12.22 are parallel to one another. When deployed, the parts 12.12, 12.21, 14.21 and 14.12 are at 45° to the vertical and the first and second connection points 16 and 18 are about 204 mm apart.

Figure 9:
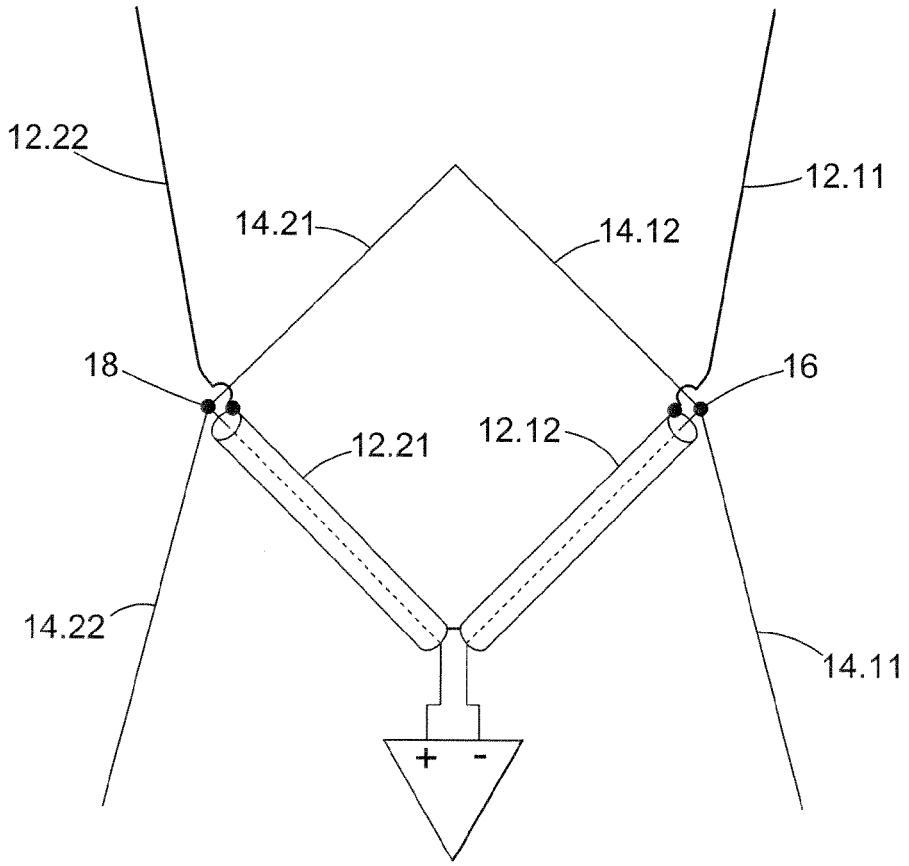
FIG. 9 is a more detailed representation of the antenna arrangement of FIG. 8.

A more detailed diagram of the electrical connections of the embodiment in FIG. 8 is shown in FIG. 9 and is self explanatory, when read with the description of FIG. 3 above.

Figure 10:
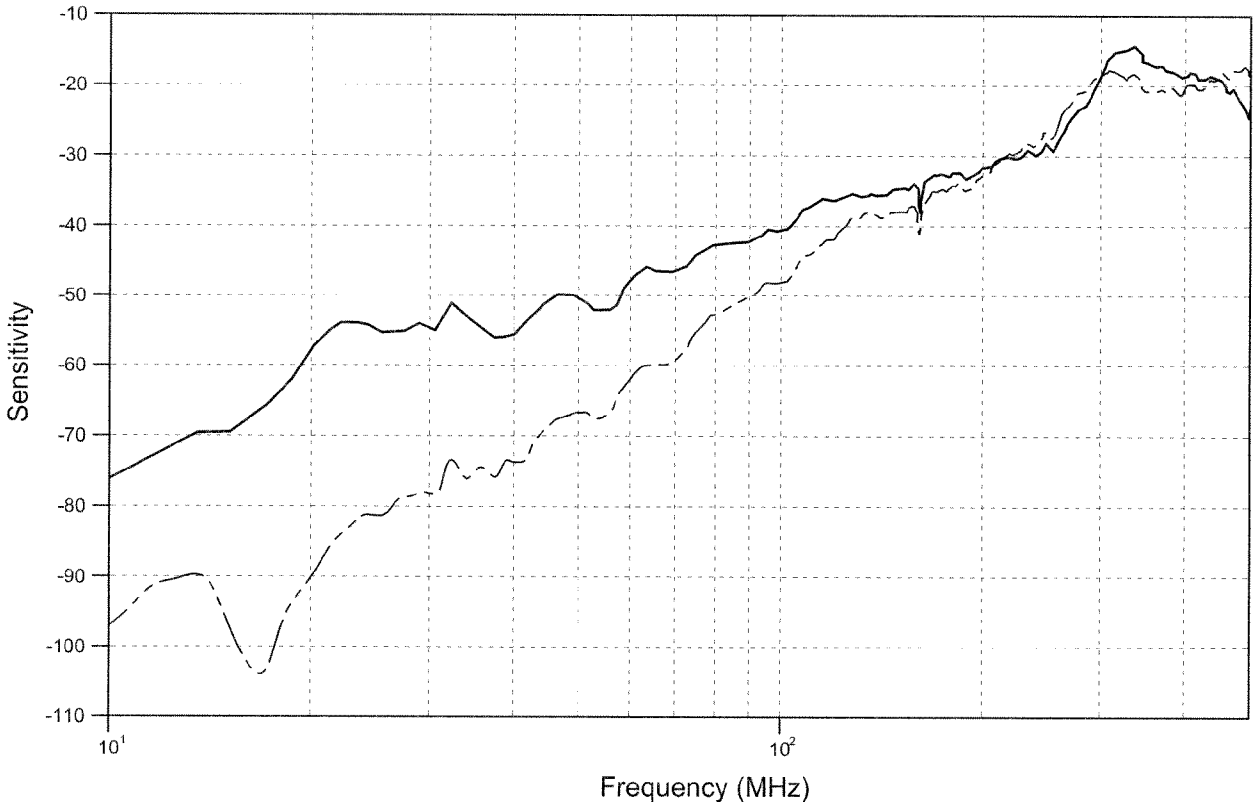
FIG. 10 show comparative graphs of sensitivity against frequency for the arrangement in FIG. 9 and a prior art Adcock arrangement.

In FIG. 10, there is shown in the solid line, a graph of sensitivity against frequency for the antenna in FIG. 9 wherein all the parts 12.12, 12.21, 14.21 and 14.12 are made of a conductive material, to form a loop antenna 20 between the opposed dipoles. Also shown, but in dotted lines, is a similar graph for a prior art Adcock arrangement. An improved sensitivity at lower frequencies of the arrangement in FIG. 9 is apparent. In another form of the embodiment of FIG. 9, the appendages 12.11, 14.11, 14.22 and 12.22 are shortened to about 150 mm in length. The advantage of this configuration is that when collapsed, the dipoles 30, 32 are only 30 cm high.

Figure 11:
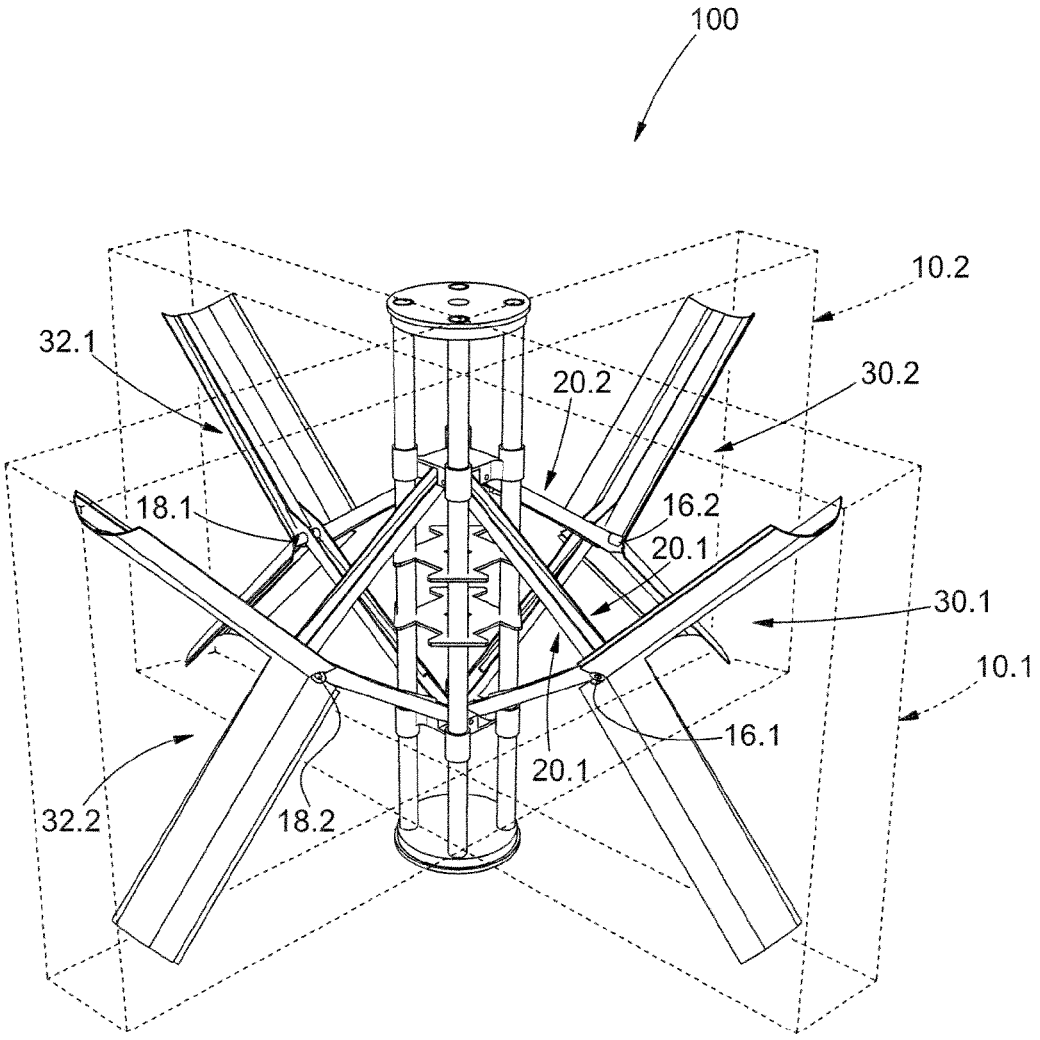
FIG. 11 is a diagrammatic three-dimensional representation of an antenna array comprising the antenna arrangement, with the array in a deployed configuration.
Figure 12:
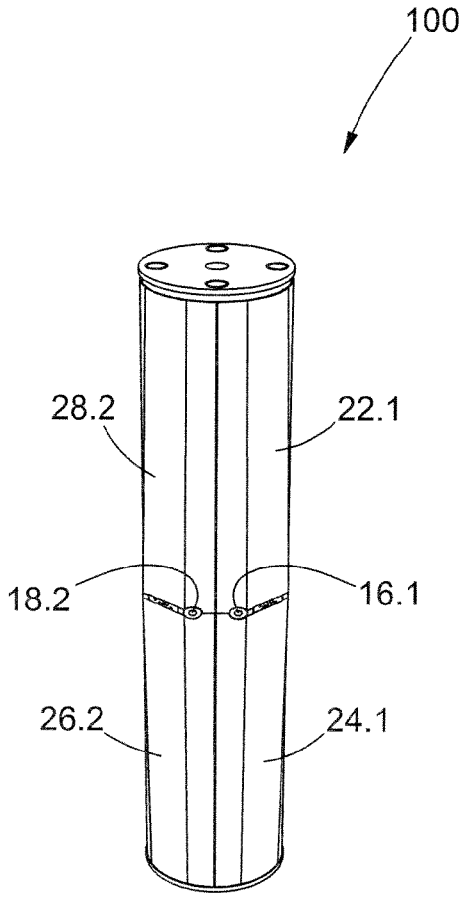
FIG. 12 is a similar view of the array in a collapsed configuration.

The antenna array 100 shown in FIGS. 11 and 12 comprises first and second arrangements 10.1 and 10.2 as herein defined and/or described, arranged in mutually orthogonal relationship relative to one another. The dipoles 30.1 and 32.1 of the first arrangement 10.1 are diametrically opposite one another and the dipoles 30.2 and 32.2 of the second arrangement 10.2 are also diametrically opposite one another and orthogonally to the dipoles of the first arrangement. The arrangements 10.1 and 10.2 are each connectable via its connection points 16.1, 18.1 and 16.2, 18.2 to its respective electronic circuitry.

In FIG. 12 the antenna array 100 is shown in the collapsed and portable configuration with only appendages 22.1 and 24.1 of arrangement 10.1 and appendages 26.2 and 28.2 of arrangement 10.2 visible.

It will be appreciated that the arrangement may alternatively be driven or fed in phase, thereby to create an omni-directional antenna arrangement.

The invention claimed is:

1. An antenna arrangement comprising:

a first elongate limb having a first end, a second end and spaced first and second electrical terminals for connection to electronic circuitry wherein the first and second electrical terminals are located between the first and second ends;

a second elongate limb having a first end, a second end and spaced first and second electrical terminals for connection to electronic circuitry wherein said first and second electrical terminals are located between the first and second ends of the second limb;

wherein the first and second elongate limbs converge towards one another at a first electrical connection point at which the first electrical terminal of the first limb and the first electrical terminal of the second limb are next to each other and at a spaced second electrical connection point at which the second electrical terminal of the first limb and the second electrical terminal of the second limb are next to each other; and wherein the first and second limbs together form a closed figure between the first and second electrical connection points, with first and second appendages to the closed figure extending from the first electrical connection point, and third and fourth appendages to the closed figure extending from the second electrical connection point.

2. An antenna arrangement as claimed in claim 1 wherein the first and second electrical connection points are connected in antiphase in that the first electrical terminal of the second limb and the second electrical terminal of the second limb are connected to a respective one of first and second ports of electronic circuitry which ports are 180 degrees out of phase.

3. An antenna arrangement as claimed in claim 1 wherein the closed figure and appendages are of an electrically conductive material and wherein each of the appendages extends in spaced juxtaposition along a portion of the closed figure adjacent thereto.

4. An antenna arrangement as claimed in claim 3 wherein the closed figure is circular and the appendages are in the form of circle segments.

5. An antenna arrangement as claimed in claim 3 wherein the closed figure is rectilinear.

6. An antenna arrangement as claimed in claim 3 wherein the closed figure is square and the appendages extend parallel to the sides of the square on the outside of the square.

7. An antenna arrangement as claimed in claim 3 wherein the closed figure is square and the appendages extend parallel to the sides of the square on the inside of the square.

8. An antenna arrangement as claimed in claim 1 wherein the first and second appendages form a first dipole and the third and second appendages form a second dipole.

9. An antenna arrangement as claimed in claim 8 wherein the closed figure is made of an electrically insulating material, so that the first dipole and the second dipole are spaced from one another adjacent opposite regions of the insulating closed figure.

10. An antenna arrangement as claimed in claim 8 wherein the closed figure, the first appendage, the second appendage, the third appendage and the fourth appendage are made of an electrically conductive material, so that there is provided a hybrid loop antenna comprising the closed figure forming a loop antenna and the first and second dipoles adjacent opposite regions of the loop antenna.

11. An antenna arrangement as claimed in claim 8 comprising a first hinge and a second hinge connecting the first and second limbs to one another with the first hinge between the first and second appendages and the second hinge between the third and fourth appendages, a third hinge on the first limb between the first and second hinges and a fourth hinge on the second limb between the first and second hinges, so that the arrangement is manipulable between a first or deployed configuration and a second collapsed configuration wherein the first and second hinges are closer to one another than in the deployed configuration.

12. An antenna arrangement as claimed in claim 8 wherein the closed figure is any one of rectangular, square and rounded.

13. An antenna array comprising a first arrangement as claimed in claim 8 and a second similar arrangement in mutually orthogonal relationship relative to one another and with each arrangement connectable to its respective electronic circuitry.

* * * * *